US005993567A

United States Patent [19]

Dolan

[11] Patent Number: 5,993,567

[45] Date of Patent: Nov. 30, 1999

[54] COMPOSITIONS AND PROCESSES FOR FORMING A SOLID ADHERENT PROTECTIVE COATING ON METAL SURFACES

[75] Inventor: Shawn E. Dolan, Sterling Heights, Mich.

[73] Assignee: Henkel Corporation, Gulph Mills, Pa.

[21] Appl. No.: 09/200,526

[22] Filed: Nov. 25, 1998

Related U.S. Application Data

[63] Continuation of application No. 08/412,233, Mar. 22, 1995, abandoned, which is a continuation-in-part of application No. PCT/US95/00205, Jan. 13, 1995, and a continuation of application No. 08/698,197, Aug. 15, 1996, Pat. No. 5,843, 242.

[51] Int. Cl.[6] ..... C23C 22/48

[52] U.S. Cl. ..... 148/247; 148/265; 148/272; 148/273

[58] Field of Search ..... 148/247, 251, 148/265, 272, 273, 275; 427/343

*Primary Examiner*—John Sheehan
*Assistant Examiner*—Andrew L. Oltmans
*Attorney, Agent, or Firm*—Ernest G. Szoke; Wayne C. Jaeschke; Novell E. Wisdom, Jr.

[57] ABSTRACT

An aqueous liquid chromate free primary composition for forming a protective coating on metals, particularly aluminum, is made by reacting cobalt(II) cations, carboxylate anions, at least one other type of coordinate complexing agent for cobalt(III) cations, and an oxidizing agent in an aqueous solution in which the molar ratio of carboxylate anions to cobalt(II) cations is from 0.10 to 6.8 and the aqueous solution contains no more than 1% of each of ammonia, ammonium ions, and nitrite ions. The primary layer formed by this or any other composition that forms a coating containing metal atoms and oxygen atoms on a metal substrate is advantageously sealed by further treatment with an aqueous solution of sodium ammonium decavanadate, optionally after an intermediate step of immersing in water for a few minutes between the primary treatment and the sealing treatment.

19 Claims, No Drawings

COMPOSITIONS AND PROCESSES FOR FORMING A SOLID ADHERENT PROTECTIVE COATING ON METAL SURFACES

CROSS-REFERENCE TO RELATED APPLICATION

This application is a continuation of U.S. application Ser. No. 08/698,197, filed Aug. 15, 1996, now U.S. Pat. No. 5,843,242, which is a continuation of Ser. No. 08/412,233, filed Mar. 22, 1995, now abandoned, which is a continuation-in-part of International Application PCT/US95/00205 filed Jan. 13, 1995 and designating the United States.

BACKGROUND OF THE INVENTION

1. Field of the Invention

This invention relates to compositions and processes for forming a protective coating on metal, particularly zinc, aluminum and/or zinc and/or aluminum alloy, more particularly aluminum and/or aluminum alloy surfaces. In one embodiment of the invention, the primary coating formed is a metal oxide containing conversion coating that solid and adherent, often, although not always colored, provides good corrosion protection to the metal surface, and functions as an excellent base for painting or similar organic based protective coatings. The coatings formed, when applied to substrates of zinc, aluminum and their alloys that contain at least 45% by weight of zinc and/or aluminum, can impart at least as much corrosion protection as do conventional coatings formed by use of hexavalent chromium containing compositions, but the compositions and processes for forming a primary coating according to this invention cause less potential environmental damage because they do not need hexavalent chromium or other identified major pollutants.

In another embodiment of the invention, the corrosion protective effect of a primary coating is further enhanced by a sealing treatment. The sealing treatment is very effective on primary coatings according the other embodiment of the invention, but is not limited thereto; it may be advantageously applied to a wide variety of primary coatings, including those formed by anodization as well as those formed by chemical conversion. The sealing treatment is especially advantageous for surfaces that are not intended to receive any further protective organic based coating such as paint or the like, but is also useful for substrates that are to be further protected in this way.

2. Discussion of Related Art

The published art believed to be most closely related is that described in WO94/00619, particularly Table II thereof and text related thereto. This reference teaches that high quality coatings can be formed on metal substrates by contacting them with aqueous compositions believed to contain cobalt(III) complex anions; the effective compositions are formed by reaction among cobalt(II) salts, carboxylate ions, and various other substances in the presence of an oxidizing agent. Other closely related published art includes U.S. Pat. No. 3,905,838 of Sep. 16, 1975 to Ito and U.S. Pat. No. 5,298,092 of Mar. 29, 1994 to Schriever.

Many of the compositions taught in this related art, although they have avoided the use of hexavalent chromium and other pollutants of the general environment, nevertheless can have adverse environmental impacts on the immediate working area for the process and any workers in this area. For example, many of the formulations previously used include high concentrations of ammonia, which causes at least a severe odor nuisance and possibly a serious health hazard to workers in the vicinity, unless expensive ventilation equipment is installed in the process area. Furthermore, the concentration of ammonia in aqueous solutions is difficult to maintain constant, as is desirable for achieving the most consistent results from the process, at the high levels previously recommended by some related art. In addition, some of the previously recommended compositions contain both nitrite ions and amines, which are generally believed to be readily capable of reacting to form nitrosamines, many of which are known carcinogens.

DESCRIPTION OF THE INVENTION

Objects of the Invention

One major object of the invention is to provide compositions and processes that have reduced adverse environmental impact compared with related previously recommended processes as described above. Another alternative object is to provide more economical compositions and processes than those previously recommended, in particular by at least one of the following means: (i) reducing the treatment time required to form an effective protective coating and (ii) lowering the concentrations of active ingredients. Still another alternative object is to provide coatings with higher corrosion resistance, as formed and/or after subsequent painting or the like.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes oligomer; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the stated objects of the invention); and the term "mole" and its variations may be applied to elemental, ionic, and any other chemical species defined by number and type of atoms present, as well as to compounds with well defined molecules.

SUMMARY OF THE INVENTION

Primary treatment compositions according to the invention are made by reaction in an aqueous solution comprising, preferably consisting essentially of, or more preferably consisting of, water and the following dissolved components:

(A) cobalt(II) cations;
(B) carboxylate anions;
(C) chemical species, exclusive of carboxylate anions, that form more stable coordination bonds with cobalt(III) cations than with cobalt(II) cations; and
(D) an oxidizing agent; and, optionally, one or more of the following components:
(E) nitrate ions;
(F) a component selected from the group consisting of alkali metal and alkaline earth metal cations; and
(G) fluoride and complex fluoride anions, wherein the ratio of the number of moles of component (B) to the number of moles of component (A) in the aqueous solution prior to reaction is from 0.10 to 6.8.

Contact of an "active" metal substrate with such a primary treatment composition results in formation on the surface of the metal substrate of an adherent conversion coating containing at least cobalt and oxygen atoms and also some metal atoms from the substrate treated. (Any metal that reacts in this way is considered to be an "active metal" within the meaning of that term hereinafter.) The coating formed by contact of a metal substrate with a primary composition according to the invention as described above, is which may be denoted hereinafter as a "primary coating", often contains microscopic size voids, some of which may extend down to the substrate metal. Accordingly, it has been found that the corrosion resistance of such coatings is often substantially improved by a secondary treatment, also called a "sealer" or "sealing" treatment, with an aqueous liquid composition that is believed to react to fill some or all of the voids in the coating formed by the primary treatment composition.

A particularly preferred secondary or sealing aqueous liquid composition according to this invention consists essentially of, or preferably consists of, water and vanadate ions, particularly decavanadate ions, which should be understood hereinafter to include not only ions with the chemical formula $V_{10}O_{28}^{-6}$ which are present in salts but protonated derivatives thereof having the general formula $V_{10}O_{(28-i)}(OH)_i^{-(6-i)}$, where i represents an integer from one to four, which are believed to be the predominant species present in aqueous solutions with a pH from 2 to 6. Cf. F. A. Cotton and G. Wilkinson, *Advanced Inorganic Chemistry,* 4th Ed., (John Wiley & Sons, New York, 1980), p. 712. This sealing composition is suitable for sealing any primary coating layer containing metal and oxygen, especially cobalt and aluminum oxides, not only the particularly preferred type of such a primary conversion coating layer according to the present invention as described above, but it is particularly preferred in combination with a primary coating as described above. This sealing composition is also suitable for sealing primary coatings formed by treating metal surfaces with compositions and processes as described in any of the following U.S. patents and copending U.S. patent applications, all of which, to the extent not inconsistent with any explicit statement herein, are hereby incorporated herein by reference: U.S. Pat. Nos. 5,098,064 of Feb. 18, 1992 to Reghi; 5,268,042 of Dec. 7, 1993 to Dolan; 5,281,282 of Jan. 25, 1994 to Dolan; 5,342,456 of Aug. 30, 1994 to Dolan et al.; 5,427,632 of Jun. 27, 1995 to Dolan; 5,356,490 of Oct. 18, 1994 to Dolan; U.S. National application Ser. No. 08/213,138 of Mar. 15, 1994 was continued as Ser. No. 08/429,431 now U.S. Pat. No. 5,534,082 of Jul. 9, 1996 to Dollman; and International Application No. PCT/US94/13273 designating the U.S. and filed Nov. 23, 1994. Furthermore, even for instances in which the claims of any of these patents and applications may be restricted to coatings formed by drying into place, coatings formed by treatment with the compositions taught therein and subsequent rinsing also are suitable primary coatings for sealing with the sealing composition and treatment according to this invention.

It has been found that in many instances results are further improved by an intermediate treatment of the primarily treated surfaces with water, preferably deionized, distilled, or similarly purified water, which optionally may contain an oxidizing agent such as nitrite ions. This intermediate treatment when used occurs between the primary and secondary treatments described above and is preferably performed by immersion, although other methods of contacting the surfaces with water are also suitable.

Various embodiments of the invention include working compositions for direct use in treating metals, concentrates from which such working compositions can be prepared by dilution with water and/or mixing with other concentrates, processes for treating metals with one or more compositions according to the invention, and extended processes including additional steps that usually are conventional per se, such as precleaning, rinsing, and, particularly advantageously, painting or some similar overcoating process that puts into place a protective coating containing an organic binder over the conversion coating formed according to a narrower embodiment of the invention. Articles of manufacture including surfaces treated according to a process of the invention are also within the scope of the invention.

DESCRIPTION OF PREFERRED EMBODIMENTS

For a variety of reasons, it is preferred that compositions according to the invention as defined above should be substantially free from many ingredients used in compositions for similar purposes in the prior art. Specifically, it is increasingly preferred in the order given, independently for each preferably minimized component listed below, that primary compositions according to the invention, when directly contacted with metal in a process according to this invention, contain no more than 1.0, 0.35, 0.10, 0.08, 0.04, 0.02, 0.01, 0.001, or 0.0002, percent of each of the following constituents: hexavalent chromium, cyanide, nitrite ions, ammonia and ammonium cations, and any coordinate complexing agents that stabilize cobalt(II) more than cobalt(III) cations. Sealing compositions according to this invention, when directly contacted with metal in a process according to this invention, preferably contain, with increasing preference in the order given, no more than 1.0, 0.35, 0.10, 0.08, 0.04, 0.02, 0.01, 0.001, or 0.0002, percent of each of the following constituents: hexavalent chromium, cyanide, nitrite ions, and any coordinate complexing agents that stabilize cobalt(II) more than cobalt(III) cations. Independently, sealing compositions according to the invention preferably contain, with increasing preference in the order given, not more than 0.033, 0.030, 0.027, 0.024, 0.021, 0.018, 0.015, 0.012, 0.009, 0.006, 0.003, 0.001, or 0.0003 moles per liter (hereinafter usually abbreviated "M") of tungsten in any anionic form.

Furthermore, in a process according to the invention that includes other steps than the drying into place on the surface of the metal of a layer of a primary composition as described above, it is preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium, except that a final protective coating system including an organic binder, more particularly those including primer coat, may include hexavalent chromium as a constituent. Any such hexavalent chromium in the protective coating is generally adequately confined by the organic binder, so as to avoid adverse environmental impact.

The concentration of component (A) reacted preferably is such that, in a working primary composition according to the invention, the concentration of cobalt atoms is, with increasing preference in the order given, not less than 0.001, 0.002, 0.004, 0.008, 0.016, 0.032, 0.040, 0.045, 0.050, 0.055, 0.060, 0.063, 0.066, 0.069, 0.072, 0.074, or 0.076 M and independently preferably is, with increasing preference in the order given, not more than 0.8, 0.6, 0.4, 0.2, 0.17, 0.14, 0.11, 0.090, 0.085, 0.080, or 0.078 M. The particular counterion(s) in the salt(s) in the form of which the cobalt(II) cations usually are added to the aqueous solution in which they are reacted are not narrowly restricted, but any counterions that bind so stably to cobalt(II) that they prevent it from being oxidized to cobalt(III) during reaction with the other components should be avoided. However, in order to minimize the prospects of unwanted interference with the desired reactions, the counterions for cobalt when added to the aqueous solution in which it is reacted are preferably selected from the group consisting of nitrate ions, which have relatively weak complex forming tendencies, and carboxylate ions that are part of component (B).

Component (B) is preferably selected from the anions of unsubstituted carboxylic acids containing from 1 to 6 carbon atoms, or more preferably, with increasing preference in the order given, not more than 5, 4, 3, or 2 carbon atoms, per molecule. Acetate ions are most preferred, largely because they are less expensive than most other carboxylates. Independently, the ratio of the number of moles of component (B) to the number of moles of component (A) in solution before any reaction between them preferably is, with increasing preference in the order given, at least 0.1, 0.2, 0.4, 0.8, 1.2, 1.5, 1.8, 2.0, 2.2, 2.3, 2.4, 2.5, or 2.6 and independently preferably is, with increasing preference in the order given, not greater than 6.5, 6.0, 5.5, 5.0, 4.5, 4.0, 3.7, 3.4, 3.1, 3.0, 2.9, 2.8, or 2.7. The most preferred concentrations of carboxylate ions are thus greater than can be supplied by cobalt(II) carboxylates themselves, and for the alternative cations that serve as counterions for this "excess" carboxylate, alkaline earth metal cations, particularly magnesium and calcium, most preferably magnesium, are preferred over alkali metal cations, although the latter can also be used. The use of carboxylic acids to supply the needed amounts of carboxylate ions, although also possible within the scope of the invention, is not preferred, because such use tends to depress the pH range below the most preferred values as set forth below.

Component (C) preferably is selected from organic compounds containing at least one nitrogen atom with an unshared electron pair per molecule of compound. Hydroxyalkyl amines, most particularly triethanol amine, are the most preferred class of materials for component (C). Independently, the ratio of molar concentration of nitrogen atoms each bearing an unshared electron pair to the molar concentration of component (A) present in solution before any reaction between them preferably is, with increasing preference in the order given, not less than 0.03, 0.06, 0.13, 0.20, 0.24, 0.26, 0.28, 0.30, 0.32, 0.34, 0.35, or 0.36 and independently preferably is, with increasing preference in the order given, not more than 2.0, 1.75, 1.50, 1.25, 1.00, 0.75, 0.60, 0.50, 0.45, 0.41, 0.39, or 0.38.

The amount and oxidizing strength of component (D) used should be sufficient to cause a change in the color and/or an increase in the ultraviolet adsorption at some wavelength in the range of 160–450 nanometers (hereinafter abbreviated "nm") of a precursor solution containing only water, components (A), (B), and (C), and any possible reaction products among these constituents, after component (D) is added to the precursor mixture solution. Ordinary ambient air or any other source of gaseous oxygen is suitable as the oxidizing agent, but for speed of preparation, convenience, and facile control of the process, soluble compounds including a peroxide and/or superoxide moiety are preferred, with peroxide more preferred and hydrogen peroxide most preferred (because it is normally the least expensive peroxide commercially available), as at least part of component (D). The ratio of the molar concentration of peroxide moieties present in the solution before reaction to the molar concentration of cobalt atoms present in the solution preferably is, with increasing preference in the order given, at least 0.05, 0.10, 0.20, 0.30, 0.40, 0.45, 0.50, 0.55, 0.60, 0.65, 0.68, 0.71, or 0.73 and independently preferably is, with increasing preference in the order given, not more than 10, 7, 5, 3, 2, 1.5, 1.0, 0.95, 0.90, 0.85, 0.80, 0.77, or 0.74. However, even when peroxide is used in preparing a primary composition according to the invention, it is preferable to keep the primary composition well aerated during use, by employing (i) a spray to contact the solution with the metal to be treated, (ii) a separate spray treater for aeration purposes in a process line through which the primary composition according to the invention is circulated during use, and/or (iii) sparging with air and/or oxygen gas in a container for the primary composition in such a process line, which container conveniently may be the immersion tank if immersion processing is used.

The presence, particularly from the beginning of reaction, of nitrate ions in the mixture reacted to make a primary composition according to this invention is generally preferred, because it has been observed that more nearly uniform coatings on aluminum are achieved by a process according to the invention in such cases. Accordingly, the ratio of the molar concentration of nitrate ions before reaction to the molar concentration of cobalt atoms in the aqueous compositions reacted to make compositions according to this invention preferably is, with increasing preference in the order given, not less than 0.05, 0.1, 0.2, 0.4, 0.6, 0.8, 1.0, 1.2, 1.4, 1.6, 1.8, 1.9, or 1.95 and independently preferably is, with increasing preference in the order given, not more than 20, 15, 10, 5, 4, 3.5, 3.0, 2.8, 2.6, 2.4, 2.2, 2.1, or 2.05.

The pH value of working primary compositions according to this invention preferably is, with increasing preference in the order given, at least 3, 4, 4.5, 5.0, 5.5, 6.0, 6.2, 6.3, 6.4, 6.5, 6.6, 6.7, or 6.8 and independently preferably is, with increasing preference in the order given, not more than 10, 9, 8.5, 8.2, 8.0, 7.9, 7.8, 7.7, 7.6, 7.5, 7.4, 7.3, or 7.2. Values of pH within these preferred ranges will generally result from using the preferred components noted above in preparing the compositions according to the invention, but the pH value may be adjusted as needed by minor additions of other acidic or basic components as generally known in the art. Values of pH higher than the preferred upper limits given above often result in rapid formation of cobalt containing precipitates, thereby making the compositions unfit for their intended use, while pH values below the preferred lower limits given above are likely to destabilize cobalt(III) sufficiently to impair the desired functioning of the compositions.

In preparing the compositions according to the invention, components (A) and (B) are preferably mixed together in aqueous solution at first in the absence of other constituents, except for the counterions of components (A) and (B), and component (C) then added to this mixture. Only after components (A), (B), and (C) have been well mixed in solution should any component (D) (except for the air in equilibrium with the aqueous solution) be added. Although the temperature during mixing is not believed to be narrowly restricted, so that any temperature between the freezing and boiling points of the solution may be used, all these additions are most preferably made while the solution is at approximately normal ambient temperature, i.e., 20–25° C.

A preferred partial concentrate primary composition according to the invention is an aqueous liquid composition that consists essentially of, or more preferably consists of, water, cobalt(II) cations, carboxylate anions, and any additional counterions needed for the latter two constituents. These partial primary concentrates preferably contain, with increasing preference in the order given, at least 1, 2.0, 2.5, 3.0, 3.3. 3.5, or 3.7% of cobalt(II) cations and independently preferably have molar ratios of carboxylate and cobalt(II) within the same preferred ranges as are indicated above for working primary compositions according to the invention. More preferably, the only essential constituents of these concentrates are water, cobalt nitrate, and alkaline earth metal, most preferably magnesium, acetate.

Ordinarily, before treatment with a primary composition according to this invention, a metal substrate surface preferably should be cleaned, and if the substrate is one of the metals such as aluminum and magnesium that are prone to spontaneous formation of thick oxide layers on their surfaces, it should also be deoxidized by processes known per se in the prior art, or other suitable processes. Preferred deoxidizing processes are described in the working examples below.

Primary compositions according to the invention can be used in processes according to the invention over a substantial range of temperatures, with formation of protective coatings generally at least slightly faster at higher temperatures within the range. As a generalization, the temperature during contact between a primary composition according to the invention and a metal substrate to be treated preferably is, with increasing preference in the order given, at least 20, 25, 28, 30, 32, 34, 35, 36, or 37° C. and if, rapid formation of an adequate coating is more important than maximum possible corrosion resistance, more preferably is, with increasing preference in the order given, at least 40, 43, 45, 47, or 49° C. Independently, as a generalization, the temperature during contact between a primary composition according to the invention and a metal substrate to be treated preferably is, with increasing preference in the order given, not more than 90, 85, 80, 75, 72, 69, 67, 65, 63, 62, 61, or 60° C.; and, if maximum possible corrosion resistance is desired, particularly when the metal substrates treated according to this invention are to be used without any painting or similar organic based protective coating, more preferably is, with increasing preference in the order given, not more than 55, 50, 45, 40, 39, or 38° C.

Contact between a primary composition according to the invention and the metal substrate being treated in a process according to the invention can be achieved by any convenient method or combination of methods. Immersion and spraying, for example, are both capable of giving completely satisfactory results. Generally, spraying achieves desired coating weights somewhat more rapidly than immersion, perhaps because of more effective mixing of the portion of the liquid primary composition in close proximity to the treated surface with the bulk of the liquid primary composition and/or the greater opportunity that is provided by spraying for atmospheric oxygen to participate in the coating forming reaction. Whatever the actual reason, at 60° C. for spraying the contact time preferably is, with increasing preference in the order given, not less than 5, 10, 20, 30, 40, 50, 60, 65, 70, 75, 80, 85, or 90 seconds (hereinafter usually abbreviated "sec") and independently preferably is, with increasing preference in the order given, not more than 30, 15, 12, 10, 8, 6, 5, 4, 3, 2.5, 2.2, 2.0, 1.8, 1.7, 1.6, or 1.55 minutes (hereinafter usually abbreviated "rain"). For immersion at 60° C., the contact time preferably is, with increasing preference in the order given, at least 0.2, 0.5, 0.8, 1.0, 1.5, 2.0, 2.5, 2.8, 3.2, 3.6, or 3.9 min and independently preferably is, with increasing preference in the order given, not more than 30, 25, 20, 15, 12, 9, 8, 7, 6, or 5 min. For immersion at 38° C., the contact time preferably is, with increasing preference in the order given, at least 2, 5, 8, 10, 11, 12, 13, or 14 min and independently preferably is, with increasing preference in the order given, primarily for reasons of economy, not more than 60, 40, 30, 25, 20, 18, 17, or 16 min. At other temperatures, the contact times generally preferably should be greater at lower temperatures and may be shorter at higher temperatures.

After treatment by contact with a primary composition according to the invention, the treated metal surface, now bearing a protective conversion coating, preferably is rinsed with water before being dried or allowed to dry. In many instances, including those in which the primary conversion coating contains cobalt, oxygen, and aluminum, even if the primary coating is not formed according to the invention as described above, but may be formed, for example, according to the teachings of WO94/00619, it is advantageous, in addition to or in lieu of ordinary rinsing that would normally be completed in a minute or less, to maintain contact between water and the surface treated with the primary treatment as described above for a more extended period of time. The total time for this intermediate treatment preferably is, with increasing preference in the order given, at least 1.0, 2.0, 3.0, 3.5, 4.0, 4.3, 4.6, or 4.9 min and independently preferably is, with increasing preference in the order given, primarily for reasons of economy, not more than 60, 30, 20, 10, 8, 7.0, 6.5, 6.0, 5.7, 5.4, or 5.1 min. Ordinarily, this intermediate treatment is preferably accomplished by immersion, because spraying for such relatively long times is likely to result in larger volumes of waste water and/or loss of water by evaporation. Ordinarily, a single immersion for the entire time desired is satisfactory and is preferred because it is more economical, but the total period of immersion can also be achieved by two or more immersions with an interval of removal of the treated substrate from contact with water between each immersion and the immediately successive immersion if any. The use of an intermediate treatment is particularly preferred when it is to be followed by a sealing treatment containing vanadium along with more than preferred amounts of anionic tungsten.

As already noted, purified water is normally preferred for this intermediate treatment, but an oxidizing agent such as nitrite ions, conveniently added in the form of sodium nitrite, may be included along with the water if desired. The temperature is not narrowly restricted, but ordinarily ambient or slightly higher than ambient temperatures in the range from 20 to 30, or better 26 to 28, °C. are preferred.

For many applications, the protective value of the coating can be further enhanced by a secondary "sealing" treatment with another composition. In related art, sealing compositions containing tungstate ions, vanadium pentoxide, and hydrogen peroxide have been recommended. However, it has now been found that tungstate is at best superfluous and often detrimental to sealing performance, and the most preferred sealing compositions according to this invention consist essentially only of water and vanadate ions and necessary counterions for the vanadate ions. Preferably, these counterions are alkali metal and/or ammonium ions, because most other vanadates are insufficiently soluble in water. Vanadates of any degree of aggregation may be used, but decavanadates are most preferred; sodium ammonium decavanadate with the chemical formula $Na_2(NH_4)_4V_{10}O_{28}$ is currently most particularly preferred, because it is the least costly commercially available source of decavanadate ions.

The concentration of vanadium atoms present in vanadate ions in a sealing composition according to this invention preferably is, with increasing preference in the order given, at least 0.002, 0.004, 0.007, 0.012, 0.020, 0.030, 0.040, 0.050, 0.055, 0.060, 0.065, 0.068, 0.070, or 0.071 M and independently preferably is, with increasing preference in the order given, primarily for reasons of economy, not more than 1.0, 0.5, 0.30, 0.20, 0.15, 0.12, 0.10, 0.090, 0.080, 0.077, 0.074, or 0.072 M. The temperature of such a sealing composition, during contact with the previously primarily treated and optionally intermediately treated metal substrate as described above preferably is, with increasing preference in the order given, at least 30, 35, 40, 45, 48, 51, 53, 55, 56, 57, 58 or 59° C. and independently preferably is, with increasing preference in the order given, not more than 90, 80, 75, 72, 69, 67, 65, 63, 62 or 61° C. At 60° C., the time of contact between such a sealing composition according to this invention and the previously primarily treated and optionally intermediately treated metal substrate as described above preferably is, with increasing preference in the order given, not less than 0.5, 1.0, 2.0, 2.5, 3.0, 3.5, 4.0, 4.3, 4.6, or 4.9 min and independently preferably is, with increasing preference in the order given, primarily for reasons of economy, not greater than 60, 30, 15, 12, 10, 8, 7.0, 6.5, 6.0, 5.7, 5.4, or 5.1 min. For other temperatures during treatment with a sealing composition of this type, shorter times are preferred at higher temperatures and longer times at lower temperatures.

An alternative but less preferred inorganic sealing treatment composition, known from related art and denoted hereinafter as "Inorganic Sealing Treatment Composition MS-1", is an aqueous solution made by reacting 3.0 grams per liter (hereinafter usually abbreviated "g/L") of dispersed finely divided vanadium pentoxide, 10.0 g/L of sodium tungstate, and 3.0 g/L of hydrogen peroxide together in water.

A secondarily preferred sealing treatment composition, denoted hereinafter as "Organic Sealing Treatment Composition #1", contains the following ingredients: 0.9% of 45% fluozirconic acid, 1.07% of 67% nitric acid, 0.48% of 75% orthophosphoric acid, and 22.6% of an aqueous solution containing 30.4% solids of a water soluble glucamino-substituted polymer of vinyl phenol made according to the directions of column 11 lines 39–52 of U.S. Pat. No. 4,963,596, with the balance being deionized or otherwise purified water, plus any aqueous ammonia needed to adjust the pH of the sealing treatment composition to 4.0. Other suitable sealing treatment compositions are taught in U.S. Pat. No. 5,226,976, the entire disclosure of which, except to the extent contrary to any explicit statement herein, is hereby incorporated herein by reference.

It has been noted that when either a preferred sealing composition according to this invention or Inorganic Sealing Treatment Composition MS-1 was used repeatedly without replenishment, a light absorption peak within the wavelength range from 650 to 850 nm was observable in the used sealing compositions, which were free of any significant absorption in this wavelength range when freshly prepared. The amount of light absorption in this wavelength range was 2 to 3 times greater with a highly preferred sealing composition containing only water and 7.5 g/L of sodium ammonium decavanadate than with a formerly preferred sealing composition made by reacting sodium tungstate, vanadium pentoxide, and hydrogen peroxide in aqueous solution. In either case, the light absorption in this wavelength range that developed during use of the sealing compositions disappeared if the used compositions were aerated for several hours. Without intending to limit the scope of the invention by any theory, it is hypothesized that (i) vanadium compounds in the sealer composition interact chemically with the layer formed by a primary treatment according to the invention and/or with the underlying substrate so as to produce a new chemical species dissolved in the sealing composition, (ii) something about this chemical interaction improves the corrosion resistance of the final coating formed, and (iii) this favorable interaction with the layer formed by the primary treatment is inhibited or varied to a less favorable interaction by the presence of tungstate in the sealing composition.

Preferably, the primary coatings sealed with a sealing treatment as described above contain at least 5, or, with increasing preference in the order given, at least 10, 15, 20, or 25 atomic percent in total of metals selected from the group consisting of aluminum, cerium, cobalt, molybdenum, titanium, tungsten, vanadium, zinc, and zirconium, more preferably from the group consisting of aluminum and cobalt. Independently, these primary coatings sealed with a sealing treatment as described above contain at least 5, or, with increasing preference in the order given, at least 10, 15, 20, or 25 atomic percent of oxygen.

After any sealing treatment used, the treated metal surfaces preferably are again rinsed before drying or being allowed to dry. If heat is used to accelerate drying, the temperature of the metal during drying preferably does not exceed, with increasing preference in the order given, 100, 85, 75, 66, or 60° C., in order to avoid damage to the protective quality of the coating formed by a process according to the invention After primary treatment according to the invention, intermediate and sealing treatments if desired, and drying, a metal substrate is well suited as a base for paint or any similar organic based protective coating, which may be applied in any manner known per se in the art. With the most preferred primary, intermediate, and secondary treatments according to this invention, aluminum substrates often have superior corrosion resistance even without any organic based protective coating.

The invention may be further appreciated by consideration of the following non-limiting working examples and test results.

EXAMPLE 1

A working primary composition according to the invention was prepared as follows: 1063 grams of an aqueous solution of cobalt(II) nitrate containing 13% of cobalt and 670 grams of magnesium acetate tetrahydrate were added to about 15 liters of deionized water. After these ingredients had been thoroughly mixed at ambient temperature, aeration of the liquid mixture was begun, 131 grams of triethanolamine of 99% purity was added, and after thorough mixing of this ingredient had been accomplished, 168 grams of an aqueous solution of hydrogen peroxide containing 35% $H_2O_2$ was added. This liquid mixture was then diluted to a total volume of 30.3 liters with additional deionized water, to produce a liquid solution according to the invention that, when diluted to 10 times its initial volume with deionized water, produces a test liquid with an absorbance of UV light at 362 nm wavelength, over a 1 cm long transmission path, in the range from 4 to 40%. Heating of the liquid was begun, and aeration was continued until the temperature of the mixture had been raised to 54±1° C., the selected working temperature, which was maintained during use of this primary composition according to the invention as described below.

Rectangular panels of Type 2024-T3 aluminum alloy that were 7.6×25.4 centimeters in size were the substrates used. These substrates were subjected to the following process steps, in which all products identified by the symbol "®" are available from the Parker Amchem Division of Henkel Corp., Madison Heights, Mich.:

1. Clean by immersion for 5 min at 60° C. in an aqueous solution containing 15 g/L of RIDOLINE® 53 silicate inhibited alkaline cleaner.
2. Rinse with hot water.
3. Deoxidize by immersion for 5 min at 21° C. in an aqueous solution containing 8.75 volume % of DEOXALUME® 2200 Deoxidizer Make up concentrate and 10.0 volume % of DEOXALUME® 2200 Deoxidizer Additive Supplemental Concentrate.
4. Rinse with cold water.
5. Immerse in the working primary composition according to the invention described next above at the temperature also noted above for 4 min.
6. Remove from contact with the working primary composition according to the invention and rinse with cold water.
7. Immerse for 5 min at 60±1° C. in Inorganic Sealing Treatment Composition MS-1 as described above.
8. Remove from contact with the Inorganic Sealing Treatment Composition MS-1 and rinse with cold water.
9. Dry by blowing with air and/or in an oven at 32 to 66° C.
10. For some of the panels, coat successively with Crown Metro™ 10-P4-2 Epoxy Primer and 443-03-1000 Topcoat.

The panels not subjected to step 10 above were tested in standard salt spray for one week and exhibited no pits or discoloration. The panels subjected to step 10 were scribed and then tested in standard salt spray. No creepage away from the scribe was detectable after 1000 hours of salt spray exposure.

EXAMPLE 2

The substrates in this example were made of aluminum casting alloy. They were subjected to the following process steps, in which all products identified by the symbol "®" are available from the Parker Amchem Division of Henkel Corp., Madison Heights, Mich.:

1. Clean by immersion for 2 min at 60° C. in an aqueous solution containing 22 g/L of RIDOLINE® 336 alkaline cleaner.
2. Rinse with hot water.
3. Deoxidize by immersion for 2 min at 21° C. in an aqueous solution containing 2 volume % of DEOXALUME® HX-357 concentrate.
4. Rinse with cold water.
5. Spray for 2 min at 54±1° C. with the same working primary composition according to the invention as for Example 1.
6. Remove from contact with the working primary composition according to the invention and rinse with cold water.
7. Immerse for 2 min at 38±1° C. in Organic Sealing Treatment Composition #1 as described above.
8. Remove from contact with the Organic Sealing Treatment Composition #1 and rinse with cold water.
9. Dry by blowing with air and/or in an oven at 32 to 66° C.
10. Coat with epoxy powder coating.

Scribed substrates treated as described above developed no detectable creepback from the scribe after 1000 hours of standard salt spray testing. Samples immersed in water at 71±1° C. for seven consecutive days, then scratched through to the substrate, taped with adhesive tape across the scratch area, and subjected to peeling away the tape thus applied showed no loss of coating adhesion.

EXAMPLE GROUP 3

In this group the primary treatment composition and test substrates were the same as for Example 1 and most of the process steps were the same, except that (i) the temperature and time of the primary treatment were varied; (ii) the composition of the sealing treatment used in step 7 was varied; (iii) in many cases an additional intermediate step (6') of immersing the substrates for 5 min in plain deionized water or in a solution of 10 g/L of sodium nitrite in deionized water, in either case maintained at 26.7±1.0° C., was used between steps 6 and 7; and (iv) none of the substrates was finally painted. The various conditions and some results are shown in Table 1 below.

TABLE 1

| Identification | Prim. Treat. | | Sealing Treatment | | | | | Salt Spray Test Results | |
|---|---|---|---|---|---|---|---|---|---|
| | | Time, | Conc. in g/L of: | | | Int. Treat. | $g/m^2$ of Co | After | After |
| Number | ° C. | Min | ST | SADV | $V_2O_5$* | ? | after | 1 Week | 2 Weeks |
| 3.1 | 38 | 6 | 10.0 | 0.0 | 3.0 | Y | 0.060 | Failed | |
| 3.2 | 38 | 7 | 10.0 | 0.0 | 3.0 | Y | 0.085 | Failed | |
| 3.3 | 38 | 8 | 10.0 | 0.0 | 3.0 | Y | 0.100 | Failed | |
| 3.4 | 38 | 9 | 10.0 | 0.0 | 3.0 | Y | 0.121 | Failed | |
| 3.5 | 38 | 10 | 10.0 | 0.0 | 3.0 | Y | 0.115 | Failed | |
| 3.6 | 38 | 11 | 10.0 | 0.0 | 3.0 | Y | 0.139 | Failed | |

TABLE 1-continued

| Identification Number | Prim. Treat. ° C. | Prim. Treat. Time, Min | Sealing Treatment Conc. in g/L of: ST | SADV | $V_2O_5$* | Int. Treat. ? | g/m² of Co after | Salt Spray Test Results After 1 Week | After 2 Weeks |
|---|---|---|---|---|---|---|---|---|---|
| 3.7 | 38 | 12 | 10.0 | 0.0 | 3.0 | Y | 0.140 | Failed | |
| 3.8 | 38 | 15 | 10.0 | 0.0 | 3.0 | Y | 0.178 | Failed | |
| 3.9 | 38 | 15 | 10.0 | 0.0 | 3.0 | Y | 0.203 | Failed | |
| 3.10 | 38 | 15 | 0.0 | 7.5 | 0.0 | Y | 0.141 | Perfect | Perfect |
| 3.11 | 38 | 15 | 10.0 | 0.0 | 3.0 | N | 0.158 | Perfect | Failed |
| 3.12 | 38 | 15.3 | 1.0 | 7.5 | 0.0 | Y | 0.183 | Perfect | Perfect |
| 3.13 | 38 | 15.3 | 3.0 | 7.5 | 0.0 | Y | 0.154 | Perfect | 3 Pits |
| 3.14 | 38 | 15.3 | 5.0 | 7.5 | 0.0 | Y | 0.203 | Failed | |
| 3.15 | 38 | 15.3 | 6.0 | 7.5 | 0.0 | Y | 0.153 | Failed | |
| 3.16 | 60 | 2.0 | 10.0 | 0.0 | 3.0 | Y | 0.174 | Perfect | Failed |
| 3.17 | 60 | 3.0 | 10.0 | 0.0 | 3.0 | Y | 0.264 | Perfect | >12 Pits |
| 3.18 | 60 | 2.0 | 6.0 | 7.5 | 0.0 | Y | 0.188 | 2 Pits | 4 Pits |
| 3.19 | 60 | 2.0 | 10.0 | 0.0 | 3.0 | N | 0.170 | Failed | |
| 3.20 | 60 | 2.0 | 6.0 | 7.5 | 0.0 | N | 0.181 | Perfect | 2 Pits |
| 3.21 | 60 | 2.0 | 10.0 | 0.0 | 3.0 | Y† | 0.176 | Failed | |
| 3.22 | 60 | 2.0 | 6.0 | 7.5 | 0.0 | Y† | 0.173 | Perfect | Failed |
| 3.23 | 53 | 3.0 | 10.0 | 0.0 | 3.0 | Y† | 0.165 | Perfect | Failed |
| 3.24 | 53 | 4.0 | 10.0 | 0.0 | 3.0 | Y† | 0.215 | Failed | |
| 3.25 | 61 | 2.0 | 6.0 | 7.5 | 0.0 | Y† | 0.192 | Perfect | 2 Pits |
| 3.26 | 61 | 2.0 | 6.0 | 7.5 | 0.0 | N | 0.214 | Perfect | Failed |
| 3.27 | 57 | 1.5 | 10.0 | 0.0 | 3.0 | N | 0.107 | Perfect | Failed |

Footnotes for Table 1

*Sealing compositions that contained this component also contained 3.0 g/L of $H_2O_2$.

†Where this symbol appears, the intermediate treatment contained 10 g/L of $NaNO_2$ in deionized water; otherwise, the intermediate treatment was with deionized water alone.

Abbreviations and Other Notes for Table 1

"Prim." means "Primary";
"Treat." means "Treatment";
"Conc." means "Concentration";
"Int." means "Intermediate";
"ST" means "Sodium Tungstate";
"SADV" means Sodium Ammonium Decavanadate;
"Y" means "Yes";
"N" means "No";
"Dis." means "Discoloration".

The values shown for g/m² of cobalt were averages from two panels at each condition for which this value is shown.

No values for salt spray testing after 2 weeks are shown for those conditions which led to failure after 1 week, because such values would be certain to be failures.

I claim:

1. A process for improving the corrosion protection afforded to an underlying metal substrate by an adherent primary coating that contains metal atoms and oxygen atoms and is formed over the metal substrate, said process comprising the steps of:

(I) contacting the adherent primary coating, for a time effective to improve the resistance to corrosion in a salt spray test of the underlying metal substrate after completion of the process, with an aqueous sealing composition comprising water, at least about 0.012 M of dissolved vanadium atoms in decavanadate anions, and dissolved counterions for the decavanadate anions and not more than about 0.030 M in total of tungsten in any anionic form; and (II) discontinuing the contacting performed in step (I) and drying the surface of the metal substrate at a temperature not greater than about 100° C.

2. A process according to claim 1, wherein the temperature of the sealing composition during its contact with the primary conversion coating is not more than about 75° C. and the time of contact between the sealing composition and the primary conversion coating is at least about 1.0 minute.

3. A process according to claim 2, wherein the temperature of the sealing composition during its contact with the primary conversion coating is at least about 30° C. and the time of contact between the sealing composition and the primary conversion coating is from about 2.0 to about 30 minutes.

4. A process according to claim 3, wherein the temperature of the sealing composition during its contact with the primary conversion coating is at least about 35° C. and the time of contact between the sealing composition and the primary conversion coating is at least about 2.5 minutes.

5. A process according to claim 4, wherein the temperature of the sealing composition during its contact with the primary conversion coating is at least about 40° C. and the time of contact between the sealing composition and the primary conversion coating is at least about 3.0 minutes.

6. A process according to claim 5, wherein the concentration of vanadium atoms in the form of decavanadate ions in the aqueous sealing composition is at least about 0.020 M, the temperature of the sealing composition during its contact with the primary conversion coating is at least about 45° C., the time of contact between the sealing composition and the primary conversion coating is at least about 3.5 minutes, and the temperature in step (II) is not greater than about 66° C.

7. A process for improving the corrosion protection afforded to an underlying metal substrate by an adherent primary coating that contains metal atoms and oxygen atoms and is formed over the metal substrate, said process comprising the steps of:

(I) contacting the adherent primary coating, for a time effective to improve the resistance to corrosion in a salt spray test of the underlying metal substrate after completion of the process, with an aqueous liquid sealing composition that has been made by dissolving in a first mass of water at least a second mass of one or more salts selected from the group consisting of salts that contain alkali metal or ammonium cations and decavanadate anions, said second mass being sufficient to contain a number of vanadium atoms that constitutes at least about 0.012 moles of vanadium atoms per liter of the aqueous liquid sealing composition, said aqueous liquid sealing composition not comprising more than about 0.030 M in total of tungsten in any anionic form; and (II) discontinuing the contacting performed in step (I) and drying the surface of the metal substrate at a temperature not greater than about 100° C.

8. A process according to claim 7, wherein the temperature of the sealing composition during its contact with the primary conversion coating is not more than about 75° C. and the time of contact between the sealing composition and the primary conversion coating is at least about 1.0 minute.

9. A process according to claim 8, wherein the temperature of the sealing composition during its contact with the primary conversion coating is at least about 30° C. and the time of contact between the sealing composition and the primary conversion coating is from about 2.0 to about 30 minutes.

10. A process according to claim 9, wherein the temperature of the sealing composition during its contact with the primary conversion coating is at least about 40° C. and the time of contact between the sealing composition and the primary conversion coating is at least about 2.5 minutes.

11. A process according to claim 10, wherein: said second mass constitutes at least about 0.020 moles of vanadium atoms per liter of the aqueous liquid sealing composition; the temperature of the sealing composition during its contact with the primary conversion coating is at least about 45° C., the time of contact between the sealing composition and the primary conversion coating is at least about 3.5 minutes, and the temperature in step (II) is not greater than about 66° C.

12. A process according to claim 11, wherein the metal of the metal substrate is selected from the group consisting of zinc, aluminum, aluminum alloys, and zinc alloys.

13. A process according to claim 12, wherein the metal substrate and its primary conversion coating are jointly selected from the group consisting of:

an aluminous surface on which a primary coating has been formed by a process comprising steps of:

(I) contacting the aluminous surface with an aqueous liquid composition of matter comprising water and:

(A) from about 0.01 to about 18% of $H_2ZrF_6$;

(B) from about 0.01 to about 10% of a water soluble or dispersible polymer of 3-(N—$C_{1-4}$ alkyl-N-2-hydroxyethylaminomethyl)-4-hydroxystyrene; and (II) drying without rinsing the surface contacted in step (I);

an aluminous surface on which a primary coating has been formed by treating the aluminous surface with an aqueous acidic coating solution comprising:

(A') an amount of hexavalent chromium ions corresponding stoichiometrically to from about 0.05 to about 1 gram of $CrO_3$ per 100 milliliters of coating solution;

(B') from about 0.22 to about 3.2 grams per 100 milliliters of coating solution of Al(F')x complex formed in situ in the aqueous acidic coating solution, or in a concentrate from which said aqueous acidic coating solution is prepared by dilution with water, by additions of hydrofluoric acid and aluminum nitrate thereto;

(C') from about 0.16 to about 2.7 grams per 100 milliliters of coating solution of fluoride ions in excess of the amount in the $Al(F)_x$ complex; and (D') sufficient tungstate anions to correspond stoichiometrically to from about 0.01 to about 0.4 grams of tungsten per 100 milliliters of coating solution, said aqueous acidic coating solution having a total acid level of at least 6.0 but less than 12.5 and a free acid level of at least 3.5 but less than 8 and a total acid to free acid ratio in the range of about 1.5 to about 2.5;

a metal surface on which a primary conversion coating has been formed by a process comprising the following steps:

(I") providing a mixture consisting essentially of water and:

(A") a dissolved component selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof and (B") a dissolved, dispersed, or both dissolved and dispersed component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates;

(II") agitating the mixture provided in step (I") for at least a sufficient time at a sufficient temperature that the mixture is free from any visually observable evidence of phase separation and is sufficiently stable that it would remain free from any visually observable evidence of phase separation during storage at a temperature in the range from 20 to 25° C. for a period of at least 100 hours;

(III") mixing with the agitated mixture from the end of step (II") a component (C") selected from the group consisting of (1) water soluble and water dispersible polymers and copolymers of x-(N—$R^1$—N—$R^2$-aminomethyl)-4-hydroxy-styrenes, where x=2, 3, 5, or 6; $R^1$ represents an alkyl group containing from 1 to 4 carbon atoms; and $R^2$ represents a substituent group conforming to the general formula $H(CHOH)_n$—, where n is an integer from 3 to 8 and mixtures of any two or more therof; and (2) dissolved hexavalent chromium to form a mixture that is sufficiently stable that it would remain free from any visually observable evidence of phase separation during storage at a temperature in the range from 20 to 25° C. for a period of at least 100 hours; and (IV") either:

(IV".1) coating the metal surface with a layer of the liquid composition from the end of step (III"), said layer having a thickness such that it contains from 1 to 300 mg/$m^2$ of the metal surface of the total amount of elements selected from the group consisting of Ti, Zr, B, Si, Ge, Sn, and drying said layer of the liquid composition from the end of step (III") into place on said metal surface, without intermediate rinsing; or (IV".2) contacting the metal surface with the liquid composition from the end of step (III") at a temperature in the range from 25 to 90° C. for a time in the range from 1 to 1800 seconds, removing the metal surface from contact with said liquid composition from the end of step (III"), rinsing said metal surface with water, and drying the rinsed metal surface;

a metal surface on which a conversion coating has been formed by a process comprising the following steps:

(I'") covering said surface with a layer of an aqueous acidic liquid composition comprising water and:

(A'") a component of anions, each of said anions consisting of (i'") at least four fluorine atoms and (ii'") at least one atom of an element selected from the group consisting of titanium, zirconium, hafnium, silicon, and boron and, optionally, (iii'") one or more oxygen atoms;

(B'") a component of cations of elements selected from the group consisting of cobalt, magnesium, manganese, zinc, nickel, tin, zirconium, iron, aluminum and copper; and (C'") sufficient free acid to give the composition a pH in the range from about 0.5 to about 5.0; and (II'") drying in place, without intermediate rinsing, said layer of an aqueous acidic liquid composition;

a metal surface on which a conversion coating has been formed by a process comprising the following steps:

(I"") providing a precursor liquid mixture consisting essentially of water and:

(A"") a dissolved component selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof and (B"") a dissolved, dispersed, or both dissolved and dispersed component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates, said precursor liquid mixture having at least one of the following characteristics: (i"") it is not optically transparent in a thickness of 1 cm; (ii"") it scatters visible light; or (iii"") it undergoes visually detectable settling of a solid phase if maintained for at least 100 hours at a temperature between its freezing point and 20° C.;

(II"") maintaining the precursor liquid mixture provided in step (I"") for at least a sufficient time at a sufficient temperature to form a stabilized liquid mixture that is free from any visually observable evidence of phase separation, is transparent when viewed in a thickness of 1 cm, and is sufficiently stable that it would remain free from any visually observable evidence of phase separation during storage at a temperature in the range from 20 to 25° C. for a period of at least 100 hours; and (III"") either:

(III"".1) coating the metal surface with a layer of the liquid composition from the end of step (II""), said layer having a thickness such that it contains from 1 to 500 $mg/m^2$ of the metal surface of the total amount of elements selected from the group consisting of Ti, Zr, B, Si, Ge, Sn, and drying said layer of the liquid composition from the end of step (II"") into place on said metal surface, without intermediate rinsing; or (III"".2) contacting the metal surface with the liquid composition from the end of step (II"") at a temperature in the range from 25 to 90° C. for a time in the range from 1 to 1800 seconds; removing the metal surface from contact with said liquid composition from the end of step (II""); rinsing said metal surface with water; and drying the metal surface; and a metal surface on which a conversion coating has been formed by a process comprising the following steps:

(I""") coating the metal surface with a liquid composition consisting essentially of:

(A""") a component of fluorometallate anions, each of said anions consisting of (i""") at least four fluorine atoms, (ii""") at least one atom of an element selected from the group consisting of titanium, zirconium, hafnium, silicon, aluminum, and boron, and, optionally, (iii""") ionizable hydrogen atoms, and, optionally, (iv""") one or more oxygen atoms;

(B""") a component of divalent or tetravalent cations of elements selected from the group consisting of cobalt, magnesium, manganese, zinc, nickel, tin, copper, zirconium, iron, and strontium in such an amount that the ratio of the total number of cations of this component to the number of anions in component (A""") is at least about 1:5 but not greater than about 3:1;

(C""") a component selected from the group consisting of phosphorus-containing inorganic oxyanions and phosphonate anions; and (D""") a component selected from the group consisting of water-soluble and water-dispersible organic polymers and polymer-forming resins; and (E""") sufficient acidity to provide a pH value for the composition within the range of about 0.5 to about 5.0; and, optionally, one or more of the following components:

(F""") a dissolved oxidizing agent;

(G""") a component selected from dissolved or dispersed complexes stabilized against settling, said complexes resulting from reaction between fluorometallate anions as recited for component (A""") and one or more materials selected from the group consisting of metallic and metalloid elements and the oxides, hydroxides, and carbonates of these metallic or metalloid elements; and (II""") drying into place on the surface of the metal the coating applied in step (I"""), without intermediate rinsing.

14. A process according to claim 7, wherein the metal of the metal substrate is selected from the group consisting of zinc, aluminum, aluminum alloys, and zinc alloys.

15. A process according to claim 14, wherein the metal substrate and its primary conversion coating are jointly selected from the group consisting of:

an aluminous surface on which a primary coating has been formed by a process comprising steps of:

(I) contacting the aluminous surface with an aqueous liquid composition of matter comprising water and:

(A) from about 0.01 to about 18% of $H_2ZrF_6$;

(B) from about 0.01 to about 10% of a water soluble or dispersible polymer of 3-(N—$C_{1-4}$ alkyl-N-2-hydroxyethylaminomethyl)-4-hydroxystyrene; and (II) drying without rinsing the surface contacted in step (I);

an aluminous surface on which a primary coating has been formed by treating the aluminous surface with an aqueous acidic coating solution comprising:

(A') an amount of hexavalent chromium ions corresponding stoichiometrically to from about 0.05 to about 1 gram of $CrO_3$ per 100 milliliters of coating solution;

(B') from about 0.22 to about 3.2 grams per 100 milliliters of coating solution of Al(F')x complex formed in situ in the aqueous acidic coating solution, or in a concentrate from which said aqueous acidic coating solution is prepared by dilution with water, by additions of hydrofluoric acid and aluminum nitrate thereto;

(C') from about 0.16 to about 2.7 grams per 100 milliliters of coating solution of fluoride ions in excess of the amount in the $Al(F)_x$ complex; and (D') sufficient tungstate anions to correspond stoichiometrically to from about 0.01 to about 0.4 grams of tungsten per 100 milliliters of coating solution, said aqueous acidic coating solution having a total acid level of at least 6.0 but less than 12.5 and a free acid level of at least 3.5 but less than 8 and a total acid to free acid ratio in the range of about 1.5 to about 2.5;

a metal surface on which a primary conversion coating has been formed by a process comprising the following steps:

(I") providing a mixture consisting essentially of water and:

(A") a dissolved component selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof and (B") a dissolved, dispersed, or both dissolved and dispersed component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates;

(II") agitating the mixture provided in step (I") for at least a sufficient time at a sufficient temperature that the mixture is free from any visually observable evidence of phase separation and is sufficiently stable that it would remain free from any visually observable evidence of phase separation during storage at a temperature in the range from 20 to 25° C. for a period of at least 100 hours;

(III") mixing with the agitated mixture from the end of step (II") a component (C") selected from the group consisting of (1) water soluble and water dispersible polymers and copolymers of x-(N—$R^1$—N—$R^2$-aminomethyl)-4-hydroxy-styrenes, where x=2, 3, 5, or 6; $R^1$ represents an alkyl group containing from 1 to 4 carbon atoms; and $R^2$ represents a substituent group conforming to the general formula $H(CHOH)_n$—, where n is an integer from 3 to 8 and mixtures of any two or more therof; and (2) dissolved hexavalent chromium to form a mixture that is sufficiently stable that it would remain free from any visually observable evidence of phase separation during storage at a temperature in the range from 20 to 25° C. for a period of at least 100 hours; and (IV") either:

(IV".1) coating the metal surface with a layer of the liquid composition from the end of step (III"), said layer having a thickness such that it contains from 1 to 300 mg/$m^2$ of the metal surface of the total amount of elements selected from the group consisting of Ti, Zr, B, Si, Ge, Sn, and drying said layer of the liquid composition from the end of step (III") into place on said metal surface, without intermediate rinsing; or (IV".2) contacting the metal surface with the liquid composition from the end of step (III") at a temperature in the range from 25 to 90° C. for a time in the range from 1 to 1800 seconds, removing the metal surface from contact with said liquid composition from the end of step (III"), rinsing said metal surface with water, and drying the rinsed metal surface;

a metal surface on which a conversion coating has been formed by a process comprising the following steps:

(I'") covering said surface with a layer of an aqueous acidic liquid composition comprising water and:

(A'") a component of anions, each of said anions consisting of (i'") at least four fluorine atoms and (ii'") at least one atom of an element selected from the group consisting of titanium, zirconium, hafnium, silicon, and boron and, optionally, (iii'") one or more oxygen atoms;

(B'") a component of cations of elements selected from the group consisting of cobalt, magnesium, manganese, zinc, nickel, tin, zirconium, iron, aluminum and copper; and (C'") sufficient free acid to give the composition a pH in the range from about 0.5 to about 5.0; and (II'") drying in place, without intermediate rinsing, said layer of an aqueous acidic liquid composition;

a metal surface on which a conversion coating has been formed by a process comprising the following steps:

(I"") providing a precursor liquid mixture consisting essentially of water and:

(A"") a dissolved component selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof and (B"") a dissolved, dispersed, or both dissolved and dispersed component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates, said precursor liquid mixture having at least one of the following characteristics: (i"") it is not optically transparent in a thickness of 1 cm; (ii"") it scatters visible light; or (iii"") it undergoes visually detectable settling of a solid phase if maintained for at least 100 hours at a temperature between its freezing point and 20° C.;

(II"") maintaining the precursor liquid mixture provided in step (I"") for at least a sufficient time at a sufficient temperature to form a stabilized liquid mixture that is free from any visually observable evidence of phase separation, is transparent when viewed in a thickness of 1 cm, and is sufficiently stable that it would remain free from any visually observable evidence of phase separation during storage at a temperature in the range from 20 to 25° C. for a period of at least 100 hours; and (III"") either:

(III"".1) coating the metal surface with a layer of the liquid composition from the end of step (II""), said layer having a thickness such that it contains from 1 to 500 mg/$m^2$ of the metal surface of the total amount of elements selected from the group consisting of Ti, Zr, B, Si, Ge, Sn, and drying said layer of the liquid composition from the end of step (II"") into place on said metal surface, without intermediate rinsing; or (III''''.2) contacting the metal surface with the liquid composition from the end of step (II'''') at a temperature in the range from 25 to 90° C. for a time in the range from 1 to 1800 seconds; removing the metal surface from contact with said liquid composition from the end of step (II''''); rinsing said metal surface with water; and drying the metal surface; and a metal surface on which a conversion coating has been formed by a process comprising the following steps:

(I'''') coating the metal surface with a liquid composition consisting essentially of:

(A'''') a component of fluorometallate anions, each of said anions consisting of (i'''') at least four fluorine atoms, (ii'''') at least one atom of an element selected from the group consisting of titanium, zirconium, hafnium, silicon, aluminum, and boron, and, optionally, (iii'''') ionizable hydrogen atoms, and, optionally, (iv'''') one or more oxygen atoms;

(B'''') a component of divalent or tetravalent cations of elements selected from the group consisting of cobalt, magnesium, manganese, zinc, nickel, tin, copper, zirconium, iron, and strontium in such an amount that the ratio of the total number of cations of this component to the number of anions in component (A'''') is at least about 1:5 but not greater than about 3:1;

(C'''') a component selected from the group consisting of phosphorus-containing inorganic oxyanions and phosphonate anions; and (D'''') a component selected from the group consisting of water-soluble and water-dispersible organic polymers and polymer-forming resins; and (E'''') sufficient acidity to provide a pH value for the composition within the range of about 0.5 to about 5.0; and, optionally, one or more of the following components:

(F'''') a dissolved oxidizing agent;

(G'''') a component selected from dissolved or dispersed complexes stabilized against settling, said complexes resulting from reaction between fluorometallate anions as recited for component (A'''') and one or more materials selected from the group consisting of metallic and metalloid elements and the oxides, hydroxides, and carbonates of these metallic or metalloid elements; and (II'''') drying into place on the surface of the metal the coating applied in step (I''''), without intermediate rinsing.

16. A process according to claim 6, wherein the metal of the metal substrate is selected from the group consisting of zinc, aluminum, aluminum alloys, and zinc alloys.

17. A process according to claim 16, wherein the metal substrate and its primary conversion coating are jointly selected from the group consisting of:

an aluminous surface on which a primary coating has been formed by a process comprising steps of:

(I) contacting the aluminous surface with an aqueous liquid composition of matter comprising water and:

(A) from about 0.01 to about 18% of $H_2ZrF_6$;

(B) from about 0.01 to about 10% of a water soluble or dispersible polymer of 3-(N—$C_{1-4}$ alkyl-N-2-hydroxyethylaminomethyl)-4-hydroxystyrene; and (II) drying without rinsing the surface contacted in step (I);

an aluminous surface on which a primary coating has been formed by treating the aluminous surface with an aqueous acidic coating solution comprising:

(A') an amount of hexavalent chromium ions corresponding stoichiometrically to from about 0.05 to about 1 gram of $CrO_3$ per 100 milliliters of coating solution;

(B') from about 0.22 to about 3.2 grams per 100 milliliters of coating solution of Al(F')x complex formed in situ in the aqueous acidic coating solution, or in a concentrate from which said aqueous acidic coating solution is prepared by dilution with water, by additions of hydrofluoric acid and aluminum nitrate thereto;

(C') from about 0.16 to about 2.7 grams per 100 milliliters of coating solution of fluoride ions in excess of the amount in the $Al(F)_x$ complex; and (D') sufficient tungstate anions to correspond stoichiometrically to from about 0.01 to about 0.4 grams of tungsten per 100 milliliters of coating solution, said aqueous acidic coating solution having a total acid level of at least 6.0 but less than 12.5 and a free acid level of at least 3.5 but less than 8 and a total acid to free acid ratio in the range of about 1.5 to about 2.5;

a metal surface on which a primary conversion coating has been formed by a process comprising the following steps:

(I") providing a mixture consisting essentially of water and:

(A") a dissolved component selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof and (B") a dissolved, dispersed, or both dissolved and dispersed component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates;

(II") agitating the mixture provided in step (I") for at least a sufficient time at a sufficient temperature that the mixture is free from any visually observable evidence of phase separation and is sufficiently stable that it would remain free from any visually observable evidence of phase separation during storage at a temperature in the range from 20 to 25° C. for a period of at least 100 hours;

(III") mixing with the agitated mixture from the end of step (II") a component (C") selected from the group consisting of (1) water soluble and water dispersible polymers and copolymers of x-(N—$R^1$—N—$R^2$-aminomethyl)-4-hydroxy-styrenes, where x=2, 3, 5, or 6; $R^1$ represents an alkyl group containing from 1 to 4 carbon atoms; and $R^2$ represents a substituent group conforming to the general formula $H(CHOH)_n$—, where n is an integer from 3 to 8 and mixtures of any two or more therof; and (2) dissolved hexavalent chromium to form a mixture that is sufficiently stable that it would remain free from any visually observable evidence of phase separation during storage at a temperature in the range from 20 to 25° C. for a period of at least 100 hours; and (IV") either:

(IV".1) coating the metal surface with a layer of the liquid composition from the end of step (III"), said layer having a thickness such that it contains from 1 to 300 mg/$m^2$ of the metal surface of the total amount of elements selected from the group consisting of Ti, Zr, B, Si, Ge, Sn, and drying said layer of the liquid composition from the end of step (III") into place on said metal surface, without intermediate rinsing; or (IV".2) contacting the metal surface with the liquid composition from the end of step (III") at a temperature in the range from 25 to 90° C. for a time in the range from 1 to 1800 seconds, removing the metal surface from contact with said liquid composition from the end of step (III"), rinsing said metal surface with water, and drying the rinsed metal surface;

a metal surface on which a conversion coating has been formed by a process comprising the following steps:

(I''') covering said surface with a layer of an aqueous acidic liquid composition comprising water and:

(A''') a component of anions, each of said anions consisting of (i''') at least four fluorine atoms and (ii''') at least one atom of an element selected from the group consisting of titanium, zirconium, hafnium, silicon, and boron and, optionally, (iii''') one or more oxygen atoms;

(B''') a component of cations of elements selected from the group consisting of cobalt, magnesium, manganese, zinc, nickel, tin, zirconium, iron, aluminum and copper; and (C''') sufficient free acid to give the composition a pH in the range from about 0.5 to about 5.0; and (II''') drying in place, without intermediate rinsing, said layer of an aqueous acidic liquid composition;

a metal surface on which a conversion coating has been formed by a process comprising the following steps:

(I'''') providing a precursor liquid mixture consisting essentially of water and:

(A'''') a dissolved component selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof and (B'''') a dissolved, dispersed, or both dissolved and dispersed component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates, said precursor liquid mixture having at least one of the following characteristics: (i'''') it is not optically transparent in a thickness of 1 cm; (ii'''') it scatters visible light; or (iii'''') it undergoes visually detectable settling of a solid phase if maintained for at least 100 hours at a temperature between its freezing point and 20° C.;

(II'''') maintaining the precursor liquid mixture provided in step (I'''') for at least a sufficient time at a sufficient temperature to form a stabilized liquid mixture that is free from any visually observable evidence of phase separation, is transparent when viewed in a thickness of 1 cm, and is sufficiently stable that it would remain free from any visually observable evidence of phase separation during storage at a temperature in the range from 20 to 25° C. for a period of at least 100 hours; and (III'''') either:

(III''''.1) coating the metal surface with a layer of the liquid composition from the end of step (II''''), said layer having a thickness such that it contains from 1 to 500 mg/m$^2$ of the metal surface of the total amount of elements selected from the group consisting of Ti, Zr, B, Si, Ge, Sn, and drying said layer of the liquid composition from the end of step (II'''') into place on said metal surface, without intermediate rinsing; or (III''''.2) contacting the metal surface with the liquid composition from the end of step (II'''') at a temperature in the range from 25 to 90° C. for a time in the range from 1 to 1800 seconds; removing the metal surface from contact with said liquid composition from the end of step (II''''); rinsing said metal surface with water; and drying the metal surface; and a metal surface on which a conversion coating has been formed by a process comprising the following steps:

(I''''') coating the metal surface with a liquid composition consisting essentially of:

(A''''') a component of fluorometallate anions, each of said anions consisting of (i''''') at least four fluorine atoms, (ii''''') at least one atom of an element selected from the group consisting of titanium, zirconium, hafnium, silicon, aluminum, and boron, and, optionally, (iii''''') ionizable hydrogen atoms, and, optionally, (iv''''') one or more oxygen atoms;

(B''''') a component of divalent or tetravalent cations of elements selected from the group consisting of cobalt, magnesium, manganese, zinc, nickel, tin, copper, zirconium, iron, and strontium in such an amount that the ratio of the total number of cations of this component to the number of anions in component (A''''') is at least about 1:5 but not greater than about 3:1;

(C''''') a component selected from the group consisting of phosphorus-containing inorganic oxyanions and phosphonate anions; and (D''''') a component selected from the group consisting of water-soluble and water-dispersible organic polymers and polymer-forming resins; and (E''''') sufficient acidity to provide a pH value for the composition within the range of about 0.5 to about 5.0; and, optionally, one or more of the following components:

(F''''') a dissolved oxidizing agent;

(G''''') a component selected from dissolved or dispersed complexes stabilized against settling, said complexes resulting from reaction between fluorometallate anions as recited for component (A''''') and one or more materials selected from the group consisting of metallic and metalloid elements and the oxides, hydroxides, and carbonates of these metallic or metalloid elements; and (II''''') drying into place on the surface of the metal the coating applied in step (I''''), without intermediate rinsing.

18. A process according to claim 1, wherein the metal of the metal substrate is selected from the group consisting of zinc, aluminum, aluminum alloys, and zinc alloys.

19. A process according to claim 18, wherein the metal substrate and its primary conversion coating are jointly selected from the group consisting of:

an aluminous surface on which a primary coating has been formed by a process comprising steps of:

(I) contacting the aluminous surface with an aqueous liquid composition of matter comprising water and:

(A) from about 0.01 to about 18% of $H_2ZrF_6$;

(B) from about 0.01 to about 10% of a water soluble or dispersible polymer of 3-(N—$C_{1-4}$ alkyl-N-2-hydroxyethylaminomethyl)-4-hydroxystyrene; and (II) drying without rinsing the surface contacted in step (I);

an aluminous surface on which a primary coating has been formed by treating the aluminous surface with an aqueous acidic coating solution comprising:

(A') an amount of hexavalent chromium ions corresponding stoichiometrically to from about 0.05 to about 1 gram of $CrO_3$ per 100 milliliters of coating solution;

(B') from about 0.22 to about 3.2 grams per 100 milliliters of coating solution of Al(F')x complex formed in situ in the aqueous acidic coating solution, or in a concentrate from which said aqueous acidic coating solution is prepared by dilution with water, by additions of hydrofluoric acid and aluminum nitrate thereto;

(C') from about 0.16 to about 2.7 grams per 100 milliliters of coating solution of fluoride ions in excess of the amount in the $Al(F)_x$ complex; and (D') sufficient tungstate anions to correspond stoichiometrically to from about 0.01 to about 0.4 grams of tungsten per 100 milliliters of coating solution, said aqueous acidic coating solution having a total acid level of at least 6.0 but less than 12.5 and a free acid level of at least 3.5 but less than 8 and a total acid to free acid ratio in the range of about 1.5 to about 2.5;

a metal surface on which a primary conversion coating has been formed by a process comprising the following steps:

(I") providing a mixture consisting essentially of water and:

(A") a dissolved component selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof and (B") a dissolved, dispersed, or both dissolved and dispersed component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates;

(II") agitating the mixture provided in step (I") for at least a sufficient time at a sufficient temperature that the mixture is free from any visually observable evidence of phase separation and is sufficiently stable that it would remain free from any visually observable evidence of phase separation during storage at a temperature in the range from 20 to 25° C. for a period of at least 100 hours;

(III") mixing with the agitated mixture from the end of step (II") a component (C") selected from the group consisting of (1) water soluble and water dispersible polymers and copolymers of x-(N—$R^1$—N—$R^2$-aminomethyl)-4-hydroxy-styrenes, where x=2, 3, 5, or 6; $R^1$ represents an alkyl group containing from 1 to 4 carbon atoms; and $R^2$ represents a substituent group conforming to the general formula $H(CHOH)_n$—, where n is an integer from 3 to 8 and mixtures of any two or more therof; and (2) dissolved hexavalent chromium to form a mixture that is sufficiently stable that it would remain free from any visually observable evidence of phase separation during storage at a temperature in the range from 20 to 25° C. for a period of at least 100 hours; and (IV") either:

(IV".1) coating the metal surface with a layer of the liquid composition from the end of step (III"), said layer having a thickness such that it contains from 1 to 300 mg/$m^2$ of the metal surface of the total amount of elements selected from the group consisting of Ti, Zr, B, Si, Ge, Sn, and drying said layer of the liquid composition from the end of step (III") into place on said metal surface, without intermediate rinsing; or (IV".2) contacting the metal surface with the liquid composition from the end of step (III") at a temperature in the range from 25 to 90° C. for a time in the range from 1 to 1800 seconds, removing the metal surface from contact with said liquid composition from the end of step (III"), rinsing said metal surface with water, and drying the rinsed metal surface;

a metal surface on which a conversion coating has been formed by a process comprising the following steps:

(I''') covering said surface with a layer of an aqueous acidic liquid composition comprising water and:

(A''') a component of anions, each of said anions consisting of (i''') at least four fluorine atoms and (ii''') at least one atom of an element selected from the group consisting of titanium, zirconium, hafnium, silicon, and boron and, optionally, (iii''') one or more oxygen atoms;

(B''') a component of cations of elements selected from the group consisting of cobalt, magnesium, manganese, zinc, nickel, tin, zirconium, iron, aluminum and copper; and (C''') sufficient free acid to give the composition a pH in the range from about 0.5 to about 5.0; and (II''') drying in place, without intermediate rinsing, said layer of an aqueous acidic liquid composition;

a metal surface on which a conversion coating has been formed by a process comprising the following steps:

(I'''') providing a precursor liquid mixture consisting essentially of water and:

(A'''') a dissolved component selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof and (B'''') a dissolved, dispersed, or both dissolved and dispersed component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates, said precursor liquid mixture having at least one of the following characteristics: (i'''') it is not optically transparent in a thickness of 1 cm; (ii'''') it scatters visible light; or (iii'''') it undergoes visually detectable settling of a solid phase if maintained for at least 100 hours at a temperature between its freezing point and 20° C.;

(II'''') maintaining the precursor liquid mixture provided in step (I'''') for at least a sufficient time at a sufficient temperature to form a stabilized liquid mixture that is free from any visually observable evidence of phase separation, is transparent when viewed in a thickness of 1 cm, and is sufficiently stable that it would remain free from any visually observable evidence of phase separation during storage at a temperature in the range from 20 to 25° C. for a period of at least 100 hours; and (III'''') either:

(III''''.1) coating the metal surface with a layer of the liquid composition from the end of step (II''''), said layer having a thickness such that it contains from 1 to 500 mg/m$^2$ of the metal surface of the total amount of elements selected from the group consisting of Ti, Zr, B, Si, Ge, Sn, and drying said layer of the liquid composition from the end of step (II"") into place on said metal surface, without intermediate rinsing; or (III"".2) contacting the metal surface with the liquid composition from the end of step (II"") at a temperature in the range from 25 to 90° C. for a time in the range from 1 to 1800 seconds; removing the metal surface from contact with said liquid composition from the end of step (II""); rinsing said metal surface with water; and drying the metal surface; and a metal surface on which a conversion coating has been formed by a process comprising the following steps:

(I"") coating the metal surface with a liquid composition consisting essentially of:

(A"") a component of fluorometallate anions, each of said anions consisting of (i"") at least four fluorine atoms, (ii"") at least one atom of an element selected from the group consisting of titanium, zirconium, hafnium, silicon, aluminum, and boron, and, optionally, (iii"") ionizable hydrogen atoms, and, optionally, (iv"") one or more oxygen atoms;

(B"") a component of divalent or tetravalent cations of elements selected from the group consisting of cobalt, magnesium, manganese, zinc, nickel, tin, copper, zirconium, iron, and strontium in such an amount that the ratio of the total number of cations of this component to the number of anions in component (A"") is at least about 1:5 but not greater than about 3:1;

(C"") a component selected from the group consisting of phosphorus-containing inorganic oxyanions and phosphonate anions; and (D"") a component selected from the group consisting of water-soluble and water-dispersible organic polymers and polymer-forming resins; and (E"") sufficient acidity to provide a pH value for the composition within the range of about 0.5 to about 5.0; and, optionally, one or more of the following components:

(F"") a dissolved oxidizing agent;

(G"") a component selected from dissolved or dispersed complexes stabilized against settling, said complexes resulting from reaction between fluorometallate anions as recited for component (A"") and one or more materials selected from the group consisting of metallic and metalloid elements and the oxides, hydroxides, and carbonates of these metallic or metalloid elements; and (II"") drying into place on the surface of the metal the coating applied in step (I""), without intermediate rinsing.

* * * * *